United States Patent [19]

Williamson

[11] Patent Number: 4,493,782

[45] Date of Patent: Jan. 15, 1985

[54] CLEANSING COMPOSITIONS COMPRISING ETHOXYLATED ALCOHOL MONOESTERS OF PHOSPHORIC ACID

[75] Inventor: Stanley C. Williamson, Des Moines, Iowa

[73] Assignee: Amchem Products, Inc., Ambler, Pa.

[21] Appl. No.: 511,690

[22] Filed: Jul. 7, 1983

[51] Int. Cl.[3] ..... C11D 1/34; C11D 3/36

[52] U.S. Cl. ..... 252/95; 252/99; 252/135; 252/156; 252/174.16; 252/DIG. 17

[58] Field of Search ..... 252/89.1, 174.16, 541, 252/95, 99; 260/952

[56] References Cited

U.S. PATENT DOCUMENTS

| | | | |
|---|---|---|---|
| 2,441,295 | 5/1948 | Cantrell et al. | 260/461 |
| 2,676,975 | 4/1954 | Fortess et al. | 260/46 |
| 2,701,958 | 2/1955 | Tiso et al. | 69/27 |
| 3,004,056 | 10/1961 | Hesse et al. | 260/461 |
| 3,235,627 | 2/1966 | Mansfield | 260/926 |
| 3,331,896 | 7/1967 | Schenck et al. | 260/980 |
| 3,624,006 | 11/1971 | Karg | 252/529 |
| 3,629,127 | 12/1971 | Palmer et al. | 252/55 |
| 3,770,855 | 11/1973 | Benson et al. | 260/987 |
| 3,951,826 | 4/1976 | Rasmussen | 252/8.9 |
| 4,018,696 | 4/1977 | Hellsten et al. | 252/135 X |
| 4,137,190 | 1/1979 | Chakrabarti et al. | 252/135 |
| 4,153,649 | 5/1979 | Griffin, Jr. | 260/950 |
| 4,212,675 | 7/1980 | Robinson | 106/18.15 |
| 4,242,217 | 12/1980 | Westermann et al. | 252/135 |
| 4,278,129 | 7/1981 | Walton | 166/263 |
| 4,331,583 | 5/1982 | Everett | 523/144 |
| 4,350,645 | 9/1982 | Kurosaki et al. | 260/978 |
| 4,367,247 | 1/1983 | Akerberg | 427/302 |

FOREIGN PATENT DOCUMENTS

| | | |
|---|---|---|
| 2014427 | 10/1971 | Fed. Rep. of Germany . |
| 2448008 | 4/1976 | Fed. Rep. of Germany . |

*Primary Examiner*—Prince E. Willis

*Attorney, Agent, or Firm*—Ernest G. Szoke; Henry E. Millson, Jr.

[57] ABSTRACT

Monoesters of phosphoric acid of the formula

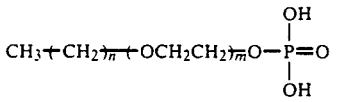

wherein n has a value from about 7 to 11, preferably from about 8–10, and m has a value from about 2 to about 4, preferably about 2.5, are good cleansing agents. The prepared product which is obtained by the reaction of the desired mixture of alcohols with 115% polyphosphoric acid contains from about 90–95% by weight of the desired esters and is preferably stabilized by the addition thereto of from about 2–3% by weight of the ester of the formula

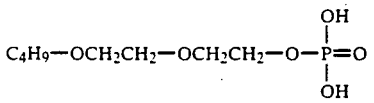

8 Claims, No Drawings

CLEANSING COMPOSITIONS COMPRISING ETHOXYLATED ALCOHOL MONOESTERS OF PHOSPHORIC ACID

This invention relates to cleansing agents. It particularly relates to phosphoric acid esters having good surfactant properties which render them useful as cleansing agents and cleansing compositions containing said esters.

BACKGROUND OF THE INVENTION

The use of esters of phosphoric acid and their salts, such as, for example, the alkali metal, ammonium, and alkanolamine salts, as cleansers, emulsifiers, corrosion inhibitors, lubricants, thickening agents, primers, fillers, and binders is well known in the art. U.S. Pat. Nos. 4,153,649; 4,212,675; 4,278,129; 4,331,583; 4,350,645; and 4,367,247 describe various phosphoric acids, their preparation and uses. Certain commercial cleansers now on the market, e.g. GAFAC RA-600 (GAF Corporation) and MONOFAX 831 (Mona Industries) are phosphoric acid esters.

The phosphoric acid esters now being marketed include both long and short chain alkyl esters, alkyl-poly(alkoxy)-alkyl esters, alkyl-phenyl-poly(alkoxy)-alkyl esters, aryl esters, aralkyl esters, and hetero esters. These esters may be monoesters of the formula

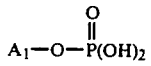

or diesters of the formula

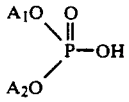

where $A_1$ and $A_2$ are the residues of the alcohol moiety and may be the same or different.

These esters possess one or more undesirable properties which detrimentally affect their utility as cleansing agents. For example, the diesters are poor detergents and have low water solubility. Many monoesters with a relatively high percentage of diesters display increased surface tension in aqueous solution as the pH increases—a property which reduces their cleansing effectiveness. Some acid esters have poor compatibility with their alkali metal salts which limits their use when both the free acid ester and salts thereof are present.

Many foam cleansers now in use are not particularly stable and tend to precipitate on standing unless large amounts of hydrotropes are added to stabilize the system. While hydrotropes do stabilize the system, they add little or nothing to the cleansing properties and are essentially dead-weight as far as providing better cleaning.

DESCRIPTION OF THE INVENTION

It is an object of this invention to provide esters of phosphoric acid consisting of at least 95% monoesters which have good cleansing properties.

It is another object of this invention to provide compositions containing monoesters of phosphoric acid having high chemical stability.

It is still another object of this invention to provide compositions containing monoesters of phosphoric acid which are so effective in solubilizing that they do not require the presence of additional hydrotropes to prevent precipitation of other active ingredients.

It is a further object of this invention to provide monoesters of phosphoric acid which are compatible with their alkali metal salts in aqueous solution.

In accordance with this invention there are provided compositions containing at least about 95% by weight of monoesters of the formula $$CH_3-(CH_2)_n-(OCH_2CH_2)_m-O-P(OH)_2O$$

wherein n has a value from about 7 to about 11, preferably from about 8 to about 10, and m has a value from about 2 to about 4, preferably about 2.5. These monoesters are effective in aqueous cleansing solutions over a wide pH range, from strongly acidic solutions to strongly alkaline solutions. However, it has been found that optimum detergency and hydrotopic action is present when the pH thereof is between about 11 and about 13. Aqueous cleansing solutions containing the novel monoester mixtures of the invention can contain from about 0.1 to about 20% by weight, preferably from about 2 to about 7% by weight, of said monoester mixture, together with cleansing solution adjuvant materials such as sodium hydroxide, phosphoric acid, sodium metasilicate and other silicates, organic phosphonate sequestrants, oxidants such as sources of chlorine, etc.

In preparing the compositions of this invention a mixture of alcohols of the formula $$CH_3-(CH_2)_n-(OCH_2CH_2)_m-OH$$

wherein n and m have the same values given above is reacted with a phosphorylating agent.

Mixtures of alcohols which have been found useful in the practice of this invention include commercially available alcohols, the main components of which have a carbon content of from 6 to 15, preferably from 8 to 12, which have been ethoxylated to contain from about 2 to about 4 ethoxyl groups. Examples of such alcohols are as follows:

| Name of Product | Parent Alcohols | No. of Ethoxy Groups |
|---|---|---|
| NEODOL 91-2.5 | $C_9$-$C_{11}$ | 2.5 |
| ALFONIC 610-50R | $C_6$,$C_8$,$C_{10}$ | 3.1 |
| ALFONIC 1012-40 | $C_{10}$,$C_{13}$,$C_{14}$ | 2.5 |
| NEODOL 25-3 | $C_{12}$-$C_{15}$ | 3 |

The NEODOLS are available from Shell and the ALFONICS from Conoco.

NEODOL 91-2.5 is an example of a preferred ethoxylated alcohol. In this product n is 8 to 10 and m is 2.5. The average molecular weight of this mixture of alcohols is about 270.

The preferred phosphorylating agent is a polyphosphoric acid analyzing from about 115% to 116% polyphosphoric acid. Such polyphosphoric acids are commercially available, e.g. from FMC Corporation.

While assay of the 115% to 116% polyphosphoric acid shows that it is a blend of acids, i.e. ortho, pyro, tri, tetra, and higher acids, for the purpose of determining the stoichiometric amount of this acid for reaction with alcohol ethoxylates, it may be calculated as if it were a blend of 3 and 4 phosphoric acid units, i.e. units of the structure

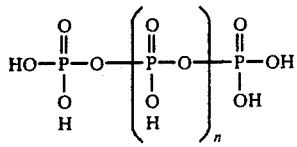

wherein n is 1 or 2. Polyphosphoric acid assaying at 115% can be treated as though it contained about 55% by weight of the 3 unit condensate and 45% by weight of the 4 unit condensate. Hence, for purposes of calculating the equivalents to be used, the 115% polyphosphoric acid can be regarded as having the formula

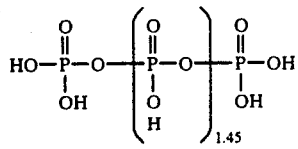

The desired ester is obtained by mixing stoichiometric equivalents of the mixtures of ethoxylated alcohols with the 115% to 116% polyphosphoric acid at ambient temperature. The reaction is exothermic so it is unnecessary to supply heat. With laboratory batches the temperature of the reaction mixture sometimes reached 158° F. so no outside cooling was needed, but some cooling may be required with reactions carried out on pilot plant or plant scale.

The invention will be clearer from the examples which follow. These examples are given by way of illustration and are not to be considered as limiting.

A slight excess of polyphosphoric acid is used to assure substantially complete esterification of the alcohol. If free alcohol is present in the final product the preparation tends to be cloudy.

EXAMPLE 1

NEODOL 91-2.5 monoester of phosphoric acid—115 g of polyphosphoric acid assaying at 115.7%, a 2% excess over the theoretical equivalent of 112.67 g was slowly added with stirring to 270 g (1 mole) of NEODOL 91-2.5. As the reaction proceeded the temperature rose to about 140° F. and remained there for several minutes. Stirring was continued for about 20 minutes to insure completion of the reaction.

A clear, syrupy, homogeneous liquid was obtained which was readily pourable, even at room temperature. It may be used directly or stored for future use. An I.R. scan showed a curve somewhat similar to that obtained from the commercial products GAFAC RA-600 or MONOFAX 831, and also indicated that substantially no free alcoholic hydroxyl groups were present.

Foam tests were carried out on the product of EXAMPLE 1 and GAFAC RA-600. Aqueous solutions containing 0.1% by weight of the products were prepared. To each solution 2% by weight of 50% liquid caustic soda was added to simulate an alkaline cleaning solution. The results of the foaming tests are as follows:

| | GAFAC RA-600 | NEODOL 91-2.5 Mono-phosphate ester |
|---|---|---|
| Initial | 140 cc | 190 cc |

-continued

| | GAFAC RA-600 | NEODOL 91-2.5 Mono-phosphate ester |
|---|---|---|
| 1 minute | 110 cc | 160 cc |
| 5 minutes | 80 cc | 130 cc |

The foaming of the novel ester of this invention is not only substantially better and richer than that of GAFAC RA-600 but is approximately equal to that of dodecylbenzene sulfonic acid. Because of the small nonionic character (only 2.5 moles of $—CH_2CH_2O—$), the salt tolerance of the product is excellent. This makes it possible to substitute sodium or a blend of sodium-potassium for all potassium systems in such products. Such a substitution would effect large cost savings.

While the viscosity of the product of EXAMPLE 1 is satisfactory for most purposes it was considered desirable to have preparations with lower viscosity which still have the other desirable properties. It was found that inclusion in the product of about 2 to about 3% by weight of the monoester of butyl carbitol ($C_4H_9—OCH_2CH_2—OCH_2CH_2OH$) and phosphoric acid resulted in preparations having viscosities in the range of about 5,000 to 6,000 cps. Furthermore, the inclusion of this monoester eliminated any cloudiness which might otherwise develop on standing.

While, as indicated above, the monoester of butyl carbitol and phosphoric acid can be added to the product of EXAMPLE 1, in actual practice it was preferred to effect the simultaneous esterification of both the NEODOL 91-2.5 and butyl carbitol as shown in EXAMPLE 2.

EXAMPLE 2

Following the procedure of EXAMPLE 1, 32.5 g of 115% polyphosphoric acid was added to a mixture of 69.0 g NEODOL 91-2.5 and 2.0 g butyl carbitol. The reaction proceeded as in EXAMPLE 1. The product can be used directly or stored for future use. The product had a viscosity in the range of 5,000 to 6,000 cps and the development of haziness which sometimes occurred in preparations of the NEODOL 91-2.5 phosphoric acid monoester was eliminated. After standing for 6 months at ambient temperature the product remained clear.

The product of EXAMPLE 2 retained the desirable properties of copious foaming, high detergency and excellent rinsing of the product of EXAMPLE 1.

Following the procedures of EXAMPLES 1 and 2 the following products were prepared using the amounts indicated in EXAMPLES 3 to 6.

EXAMPLE 3

| | Grams |
|---|---|
| ALFONIC 1012-40 | 68.4 |
| Butyl carbitol | 2.0 |
| 115% Polyphosphoric acid | 29.6 |

EXAMPLE 4

| | Grams |
|---|---|
| ALFONIC 1012-40 | 60.2 |
| Butyl carbitol | 7.8 |

-continued

| | Grams |
|---|---|
| 115% Polyphosphoric acid | 32.0 |

The product remained clear—indicating that a much larger amount of butyl carbitol must be used along with ALFONIC 1012-40.

EXAMPLE 5

| | Grams |
|---|---|
| ALFONIC 610-50R | 66.7 |
| Butyl carbitol | 1.9 |
| 115% Polyphosphoric acid | 31.4 |

The product showed good foaming and remained clear.

EXAMPLE 6

NEODOL 25-3 when phosphorylated with 115% polyphosphoric acid in the absence of butyl carbitol yielded a product which was so viscous as to be unmanageable.

The results from EXAMPLES 3 to 6 indicate that ethoxylated alcohols derived from parent alcohols having less than 8 or more than 12 carbon atoms, while still effective, are not as satisfactory as those in the preferred $C_8$ to $C_{12}$ range.

EXAMPLE 7

An aqueous cleansing composition was prepared by mixing together the following ingredients:

| Ingredient | Quantity |
|---|---|
| NEODOL 91-2.5 monoester of phosphoric acid (prepared as in EXAMPLE 1) | 2% |
| Orthophosphoric acid | 34% |

The above cleansing composition combines the characteristics of high foaming, good detergency, and good rinsing.

EXAMPLE 8

The monoester phosphoric acid products of EXAMPLES 1, 4 and 5 were each added to water at a concentration of 0.1% by weight, and sodium hydroxide was added until the pH reached about 12.0. The surface tensions of the resulting solutions were then measured and are listed in the table given below:

| Monoester | Surface Tension (dynes/cm) |
|---|---|
| EXAMPLE 1 | 28.8 |
| EXAMPLE 4 | 28.3 |
| EXAMPLE 5 | 29.4 |

The above results show that the novel esters of the invention provide outstanding detergency, even when used in relatively small quantities.

The novel esters of this invention readily mix with other known cleanser materials to form stable preparations having excellent cleansing properties. These novel esters have good resistance to oxidation and are stable when mixed with preparations containing oxidants, such as, for example, bleach. A liquid preparation comprising 5% by weight of the NEODOL 91-2.5 phosphoric acid ester of this invention, 5% sodium metasilicate, 10% sodium hydroxide, 4% of an organic phosphonate sequestrant, and a chlorine preparation was found to be stable and an excellent cleanser when used under difficult conditions such as in slaughter houses.

What is claimed is:

1. A cleansing composition containing (a) from about 0.1 to about 20% by weight of a mixture of monoesters of phosphoric acid of the formula $$CH_3(CH_2)_n(OCH_2CH_2)_mO-P(=O)(OH)_2$$

wherein n has a value from about 7 to about 11 and m has a value from about 2 to about 4, wherein said mixture contains at least 95% of said monoesters, (b) from about 2 to about 3% by weight of an ester of the formula $$C_4H_9-O-CH_2CH_2-O-CH_2CH_2-O-P(=O)(OH)_2.$$

2. A cleansing composition according to claim 1 wherein m has a value of about 2.5.

3. A cleansing composition according to claim 2 wherein n has a value from about 8 to about 10.

4. A cleansing composition in accordance with claim 1 wherein component (a) is present in from about 2 to about 7% by weight.

5. A cleansing composition in accordance with claim 1 wherein the pH of the composition is in the range of from about 11 to about 13.

6. A cleansing composition in accordance with claim 1 which additionally comprises at least one of the following cleansing composition adjuvant materials:

(i) sodium hydroxide, (ii) phosphoric acid, (iii) a silicate, (iv) an organic phosphonate sequestrant, and (v) an oxidant.

7. A cleansing composition in accordance with claim 6 wherein said adjuvant material is sodium hydroxide.

8. A cleansing composition in accordance with claim 6 wherein said adjuvant material is phosphoric acid.

* * * * *